US008646609B1

(12) United States Patent
Chen

(10) Patent No.: US 8,646,609 B1
(45) Date of Patent: Feb. 11, 2014

(54) OIL COLLECTION TRAY

(76) Inventor: Mei-Miao Chen, Dacun Township, Changhua County (TW)

( * ) Notice: Subject to any disclaimer, the term of this patent is extended or adjusted under 35 U.S.C. 154(b) by 44 days.

(21) Appl. No.: 13/561,319

(22) Filed: Jul. 30, 2012

(51) Int. Cl.
*B65D 21/00* (2006.01)

(52) U.S. Cl.
USPC ..... 206/505; 220/571; 141/98

(58) Field of Classification Search
USPC ..... 206/509, 503, 511, 515, 519, 520, 559, 206/564, 567, 565, 568, 505; 184/106; 220/571, 572, 573; 141/86, 87, 88, 141/331, 332, 338, 319, 2, 340, 337, 98
See application file for complete search history.

(56) References Cited

U.S. PATENT DOCUMENTS 2,774,511 A * 12/1956 Menkin et al. ..... 206/507
4,332,282 A * 6/1982 Strange ..... 141/1
4,632,268 A * 12/1986 Melzi et al. ..... 220/573
4,815,604 A * 3/1989 O'Neil et al. ..... 206/518
5,123,461 A * 6/1992 Belokin et al. ..... 141/98
5,285,824 A * 2/1994 Krstovic ..... 141/1
5,562,131 A * 10/1996 Drawbaugh ..... 141/98
6,085,806 A * 7/2000 Davis et al. ..... 141/98
6,543,284 B2 * 4/2003 Hoeting et al. ..... 73/427
6,880,589 B2 * 4/2005 Camoli ..... 141/98
7,637,387 B1 * 12/2009 Cantolino ..... 220/571
8,100,140 B1 * 1/2012 Cantolino ..... 137/312
2008/0169293 A1 * 7/2008 Kurtz et al. ..... 220/571
2010/0175408 A1 * 7/2010 Korda ..... 62/291

* cited by examiner

*Primary Examiner* — Jacob K Ackun
*Assistant Examiner* — Jenine Pagan
(74) *Attorney, Agent, or Firm* — Jackson IPG PLLC

(57) ABSTRACT

An oil collection tray includes a flange and a tray body which is inclined inward. The tray body has an inner wall which is inclined inward. The tray body has a plurality of spaced vertical recesses formed on an outer wall thereof and a plurality of protruding ribs formed on the inner wall thereof corresponding in position to the vertical recesses. When a number of oil collection trays are piled up, the tray body of the upper oil collection tray is placed into the tray body of the lower oil collection tray. The tray body of the upper oil collection tray extrudes the air O inside the tray body of the lower oil collection tray.

5 Claims, 8 Drawing Sheets

OIL COLLECTION TRAY

BACKGROUND OF THE INVENTION

1. Field of the Invention

The present invention relates to an oil collection tray. The same oil collection trays can be piled up and taken out with ease to decrease the volume for transportation and to lower the cost.

2. Description of the Prior Art

FIG. 5 through FIG. 8 and FIG. 5-A are to show a conventional oil collection tray A. As shown in FIG. 5 and FIG. 5-A, the middle section of the tray body A1 of the oil collection tray A has a datum line A0. The outer diameter of the portion above the datum line A0 is larger than that of the portion below the datum line A0, so that a striding face A10 is formed at the position of the datum line A0. The portion above the striding face A10 is called as a large tray body A101, and the portion below the striding face A10 is called as a small tray body A102. The outer diameter of the small tray body A102 is about equal to the inner diameter of the large tray body A101. The oil collection tray A has an oil nozzle A2 at one side thereof. The oil nozzle A2 communicates with the inside of the oil collection tray A. Referring to FIG. 6 and FIG. 7, a number of the conventional oil collection trays A are piled up, the small tray body A102 of the upper oil collection tray A is placed into the large tray body A101 of the lower oil collection tray A. The striding face A10 of the upper oil collection tray A is placed on top of the flange A11 of the lower oil collection tray A. As shown in FIG. 8, the oil collection trays are piled up to reduce the volume for transportation. The conventional oil collection tray has the problems as below.

1. The height of the small tray body below the striding face is less than that of the large tray body for piling the oil collection trays. If the height of the small tray body below the striding face is greater than that of the large tray body, the upper tray body can't be placed into the lower tray body smoothly because the air inside the lower tray body causes a resistance to the upper tray body, as shown in FIG. 6. That's the reason why the height of the small tray body is less than that of large tray body. When piling the oil collection trays, the small tray body has less resistance to exclude the air with ease so that the small tray body of the upper oil collection tray can be placed into the large tray body of the lower oil collection tray and blocked by the striding face, as shown in FIG. 7. The number of the piled oil collection trays is limited. This increases the volume and the cost, as shown in FIG. 8.

2. When piling the conventional oil collection trays, the same oil collection trays cannot be positioned in the same direction as shown in FIG. 7 and the piled oil collection trays may be turned. The oil nozzles of the oil collection trays cannot be positioned at the same perpendicular line so the oil collection trays are untidy and disordered. The space cannot be used effectively. Besides, the protruding oil nozzles occupy a lot of space.

Accordingly, the inventor of the present invention has devoted himself based on his many years of practical experiences to solve these problems.

SUMMARY OF THE INVENTION

The primary object of the present invention is to provide an oil collection tray. The oil collection tray comprises a flange and a tray body which is inclined inward. The tray body has an inner wall which is inclined inward. The tray body has a plurality of spaced vertical recesses formed on an outer wall thereof and a plurality of protruding ribs formed on the inner wall thereof corresponding in position to the vertical recesses. When a number of oil collection trays are piled up, the tray body of the upper oil collection tray is placed into the tray body of the lower oil collection tray. The tray body of the upper oil collection tray extrudes the air O inside the tray body of the lower oil collection tray. The air O is expelled from the gaps defined between the protruding ribs of the tray body of the lower oil collection tray and the vertical recesses of the tray body of the upper oil collection tray until the vertical recesses of the tray body of the upper oil collection tray mate with the protruding ribs of the tray body of the lower oil collection tray. The flange of the upper oil collection tray is located on top of the flange of the lower oil collection tray. In this way, the same oil collection trays can be piled up with ease to decrease the volume for transportation and to lower the cost.

The outer wall of the tray body of the oil collection tray is formed with the plurality of vertical recesses, and the inner wall of the tray body of the oil collection tray is formed with the plurality of protruding ribs corresponding in shape to the vertical recesses. When the oil collection trays are piled up, the vertical recesses of the tray body of the upper oil collection tray will mate with the protruding ribs of the tray body of the lower oil collection tray. The oil collection trays in the same specification can be piled up. Through the protruding ribs of the tray body of the lower oil collection tray to engage with the vertical recesses of the tray body of the upper oil collection tray, the piled oil collection trays can be positioned in the same direction. The oil nozzles of the oil collection trays are positioned in the same perpendicular line, so that the oil collection trays can be piled orderly and stored easily to decrease the storage space.

The vertical recesses of the tray body of the oil collection tray extend to the bottom of the oil collection tray to form L-shaped recesses. When the tray body of the upper oil collection tray is placed into the tray body of the lower oil collection tray, the air O will be expelled from the L-shaped recesses to expel the air smoothly.

The vertical recesses of the tray body of the oil collection tray have a tapered shape and the protruding ribs also have a tapered shape corresponding in shape to the vertical recesses, so that the tapered protruding ribs of the tray body of the lower oil collection tray can mate with the tapered vertical recesses of the tray body of the upper oil collection tray with ease to provide an alignment effect.

BRIEF DESCRIPTION OF THE DRAWINGS

FIG. 1-A is a bottom perspective view according to the preferred embodiment of the present invention;

FIG. 5-A is a bottom perspective view of the conventional oil collection tray;

DETAILED DESCRIPTION OF THE PREFERRED EMBODIMENTS

Embodiments of the present invention will now be described, by way of example only, with reference to the accompanying drawings.

Figure 1:
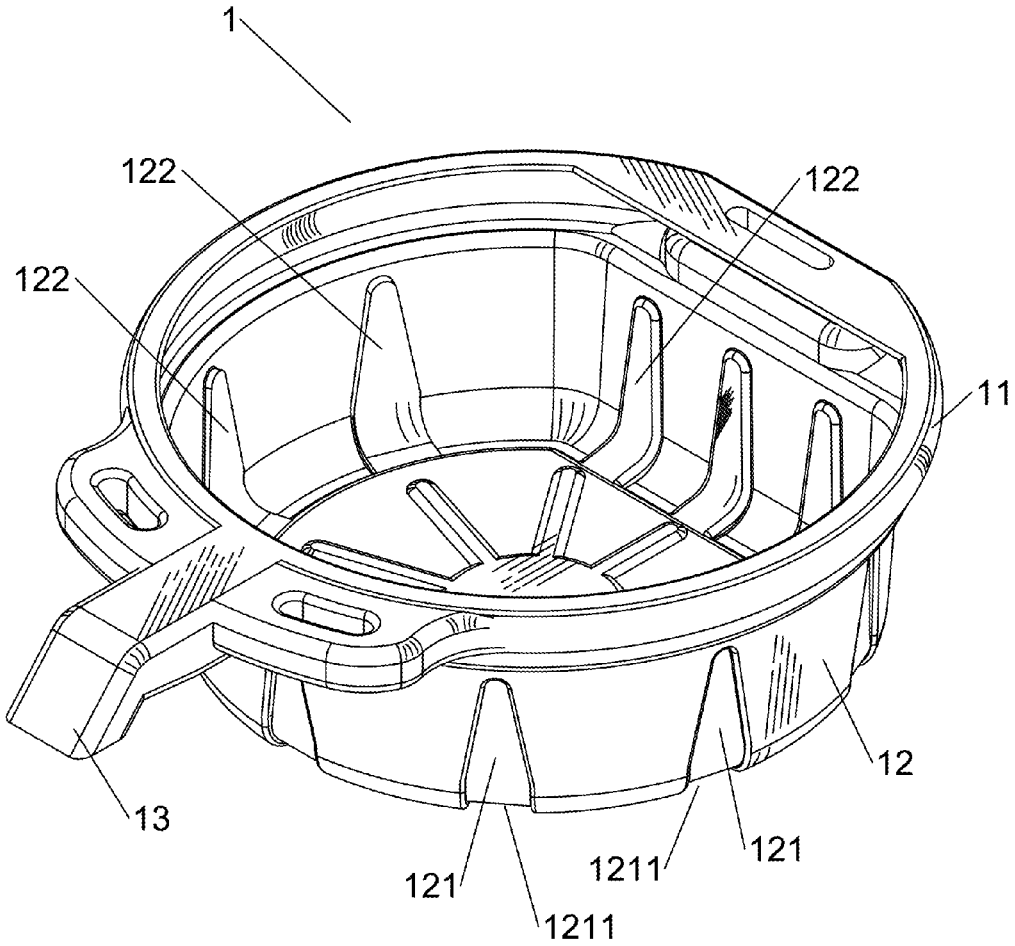
FIG. 1 is a perspective view according to a preferred embodiment of the present invention.
Figure 1A:
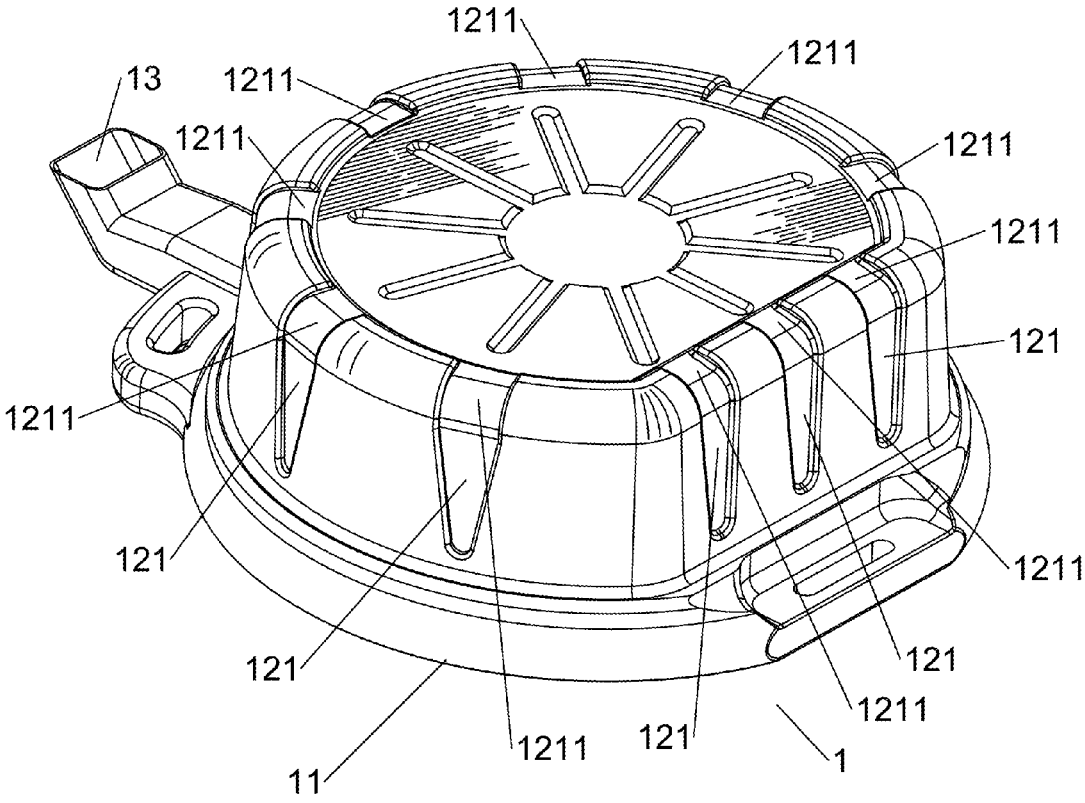
Figure 2:
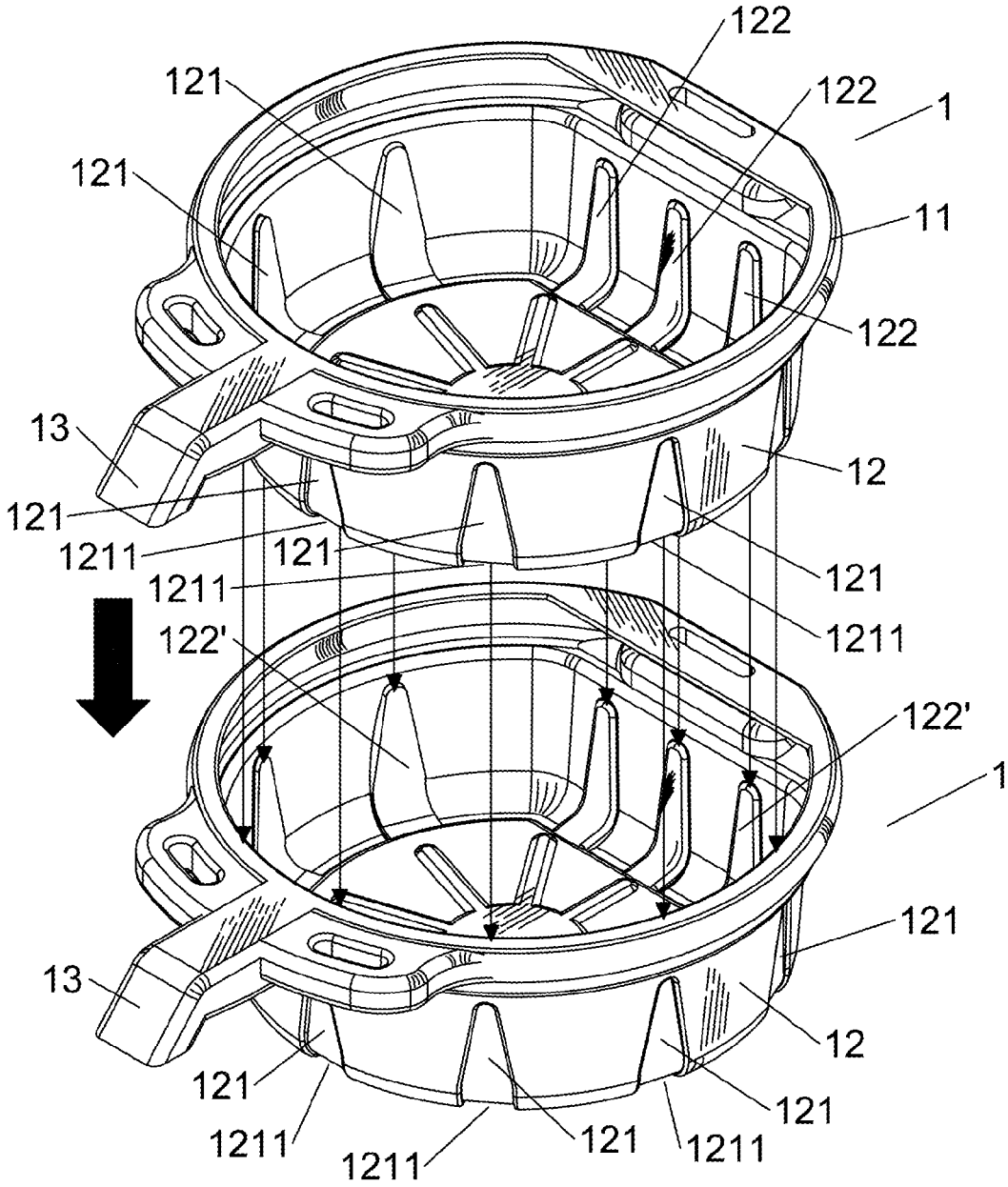
FIG. 2 is a perspective view showing the piled oil collection trays according to the preferred embodiment of the present invention.
Figure 3:
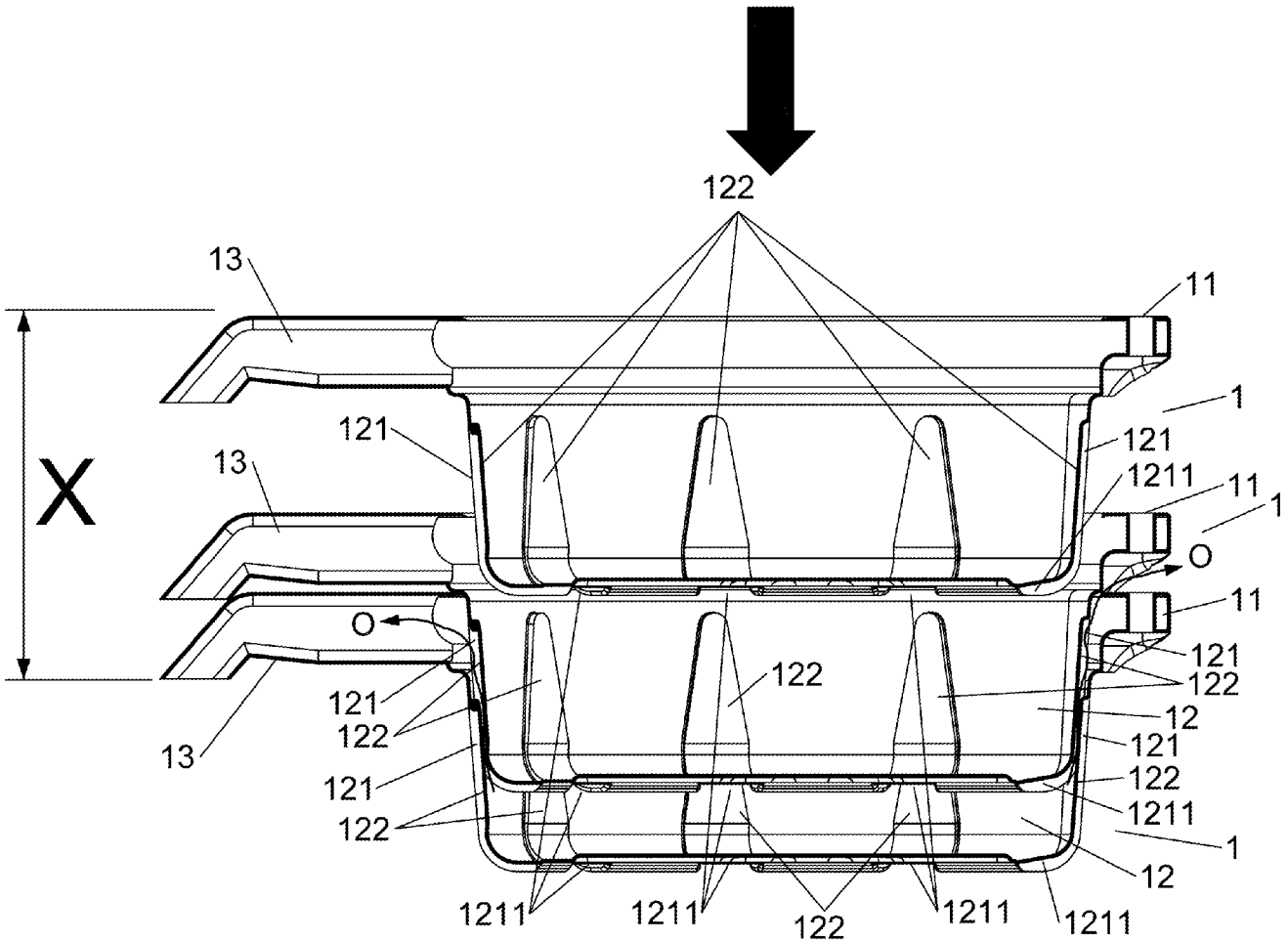
FIG. 3 is a sectional view showing the piled oil collection trays according to the preferred embodiment of the present invention.
Figure 4:
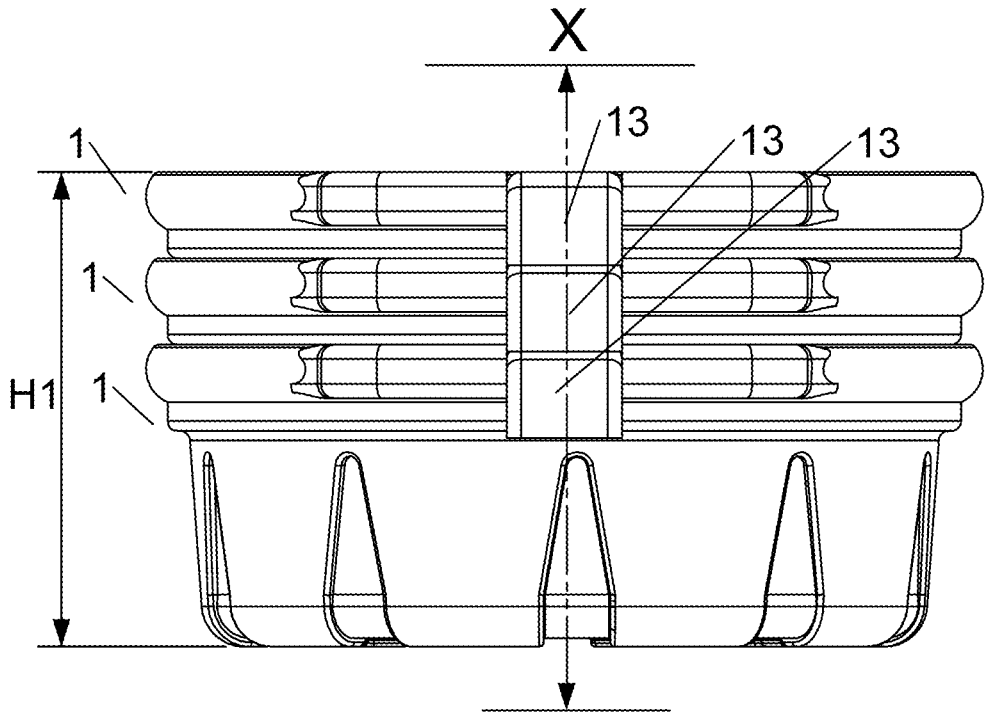
FIG. 4 is a plan view showing the piled oil collection trays according to the preferred embodiment of the present invention.

As shown in FIG. 1 to FIG. 4 and FIG. 1-A, an oil collection tray 1 of the present invention comprises a flange 11 and a tray body 12 which is inclined inward. The tray body 12 has an inner wall which is inclined inward. The tray body 12 has a plurality of spaced vertical recesses 121 formed on an outer wall thereof and a plurality of protruding ribs 122 formed on the inner wall thereof corresponding in position to the vertical recesses 121. As shown in FIG. 2 and FIG. 3, when a number of oil collection trays 1 are piled up, the tray body 12 of the upper oil collection tray 1 is placed into the tray body 12 of the lower oil collection tray 1. The tray body 12 of the upper oil collection tray 1 extrudes the air O inside the tray body 12 of the lower oil collection tray 1. The air O is expelled from the gaps defined between the protruding ribs 122 of the tray body 12 of the lower oil collection tray 1 and the vertical recesses 121 of the tray body 12 of the upper oil collection tray 1 until the vertical recesses 121 of the tray body 12 of the upper oil collection tray 1 mate with the protruding ribs 122 of the tray body 12 of the lower oil collection tray 1. The flange 11 of the upper oil collection tray 1 is located on top of the flange 11 of the lower oil collection tray 1. In this way, the same oil collection trays 1 can be piled up with ease to decrease the volume for transportation and to lower the cost, as shown in FIG. 4.

As shown in FIG. 3 and FIG. 4, the outer wall of the tray body 12 of the oil collection tray 1 is formed with the plurality of vertical recesses 121, and the inner wall of the tray body 12 of the oil collection tray 1 is formed with the plurality of protruding ribs 122 corresponding in shape to the vertical recesses 121. When the oil collection trays 1 are piled up, the vertical recesses 121 of the tray body 12 of the upper oil collection tray 1 will mate with the protruding ribs 122 of the tray body 12 of the lower oil collection tray 1. The oil collection trays 1 in the same specification can be piled as desired, as shown in FIG. 3 and FIG. 4. Through the protruding ribs 122 of the tray body 12 of the lower oil collection tray 1 to engage with the vertical recesses 121 of the tray body 12 of the upper oil collection tray 1, the piled oil collection trays 1 can be positioned in the same direction. The oil nozzles 13 of the oil collection trays 1 are positioned in the same perpendicular line X, as shown in FIG. 3 and FIG. 4, so that the oil collection trays 3 can be piled orderly and stored easily to decrease the storage space.

As shown in FIG. 3, the vertical recesses 121 of the tray body 12 of the oil collection tray 1 extend to the bottom of the oil collection tray 1 to form L-shaped recesses 1211. When the tray body 12 of the upper oil collection tray 1 is placed into the tray body 12 of the lower oil collection tray 1, the air O will be expelled from the L-shaped recesses 121 to expel the air smoothly.

Referring to FIG. 1 to FIG. 4, the vertical recesses 121 of the tray body 12 of the oil collection tray 1 have a tapered shape and the protruding ribs 122 also have a tapered shape corresponding in shape to the vertical recesses 121, so that the tapered protruding ribs 122 of the tray body 12 of the lower oil collection tray 1 can mate with the tapered vertical recesses 121 of the tray body 12 of the upper oil collection tray 1 with ease to provide an alignment effect.

Figure 5:
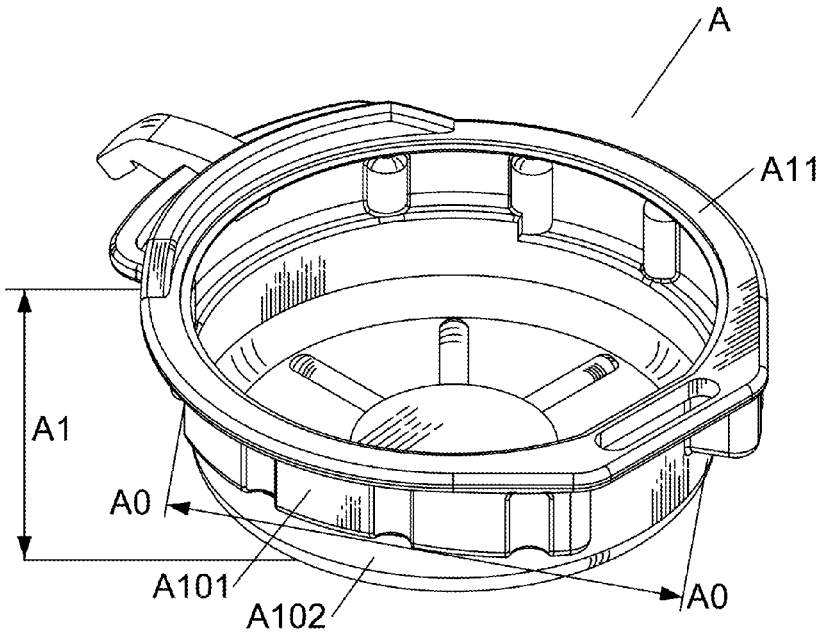
FIG. 5 is a perspective view of a conventional oil collection tray.
Figure 5A:
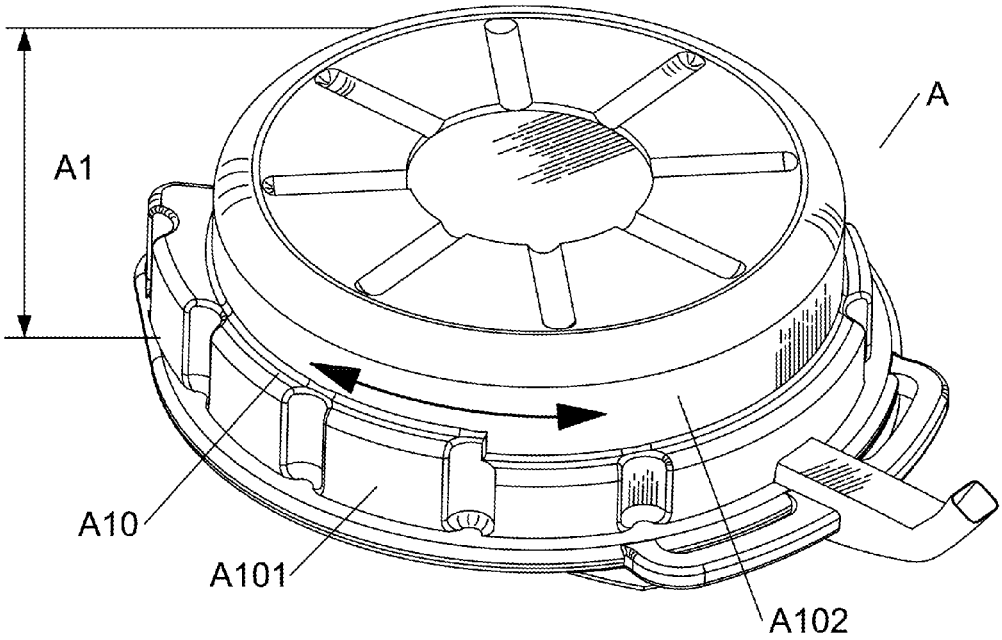
Figure 6:
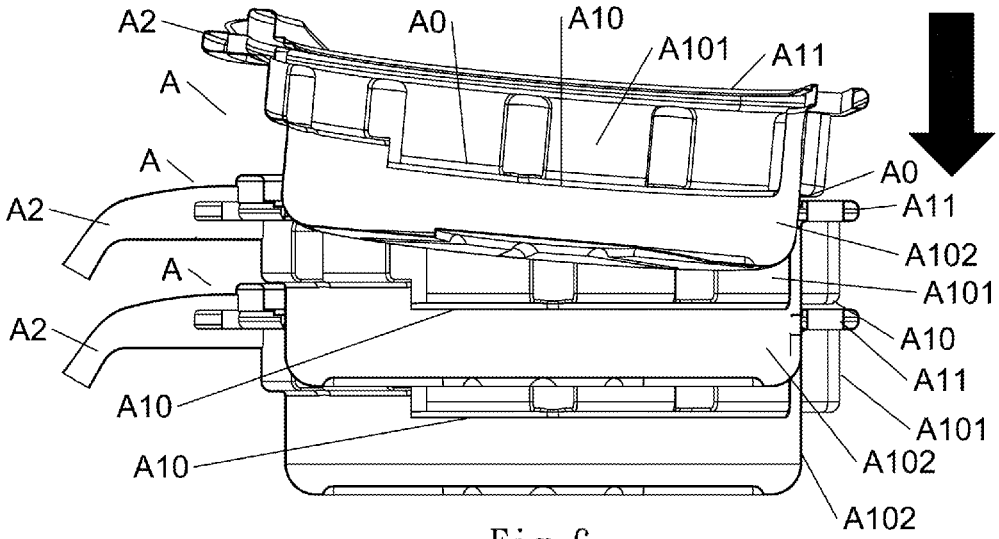
FIG. 6 is a side view showing the conventional piled oil collection trays.
Figure 7:
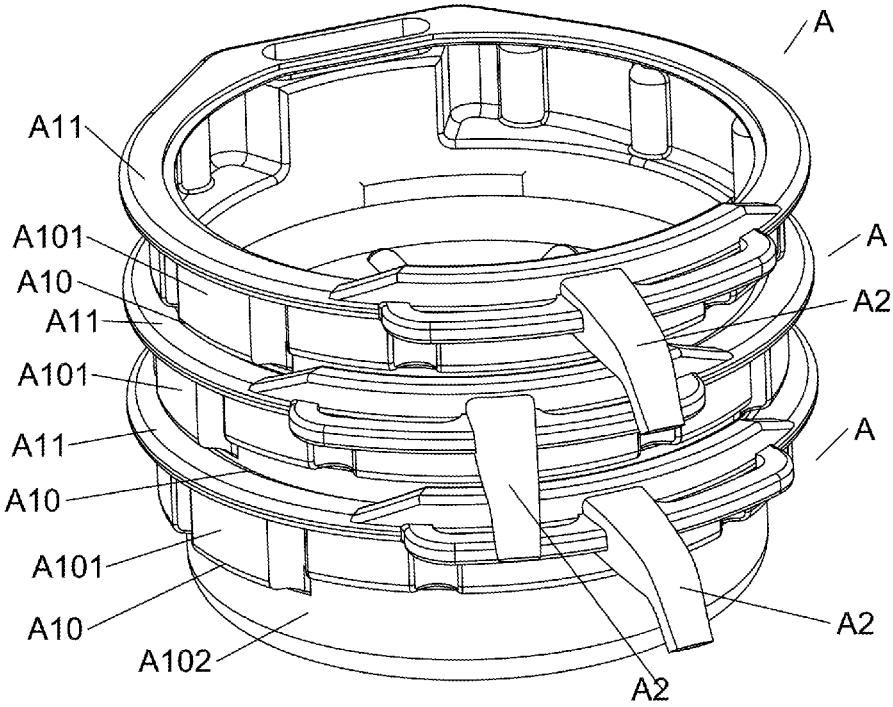
FIG. 7 is a perspective view showing the conventional piled oil collection trays.
Figure 8:
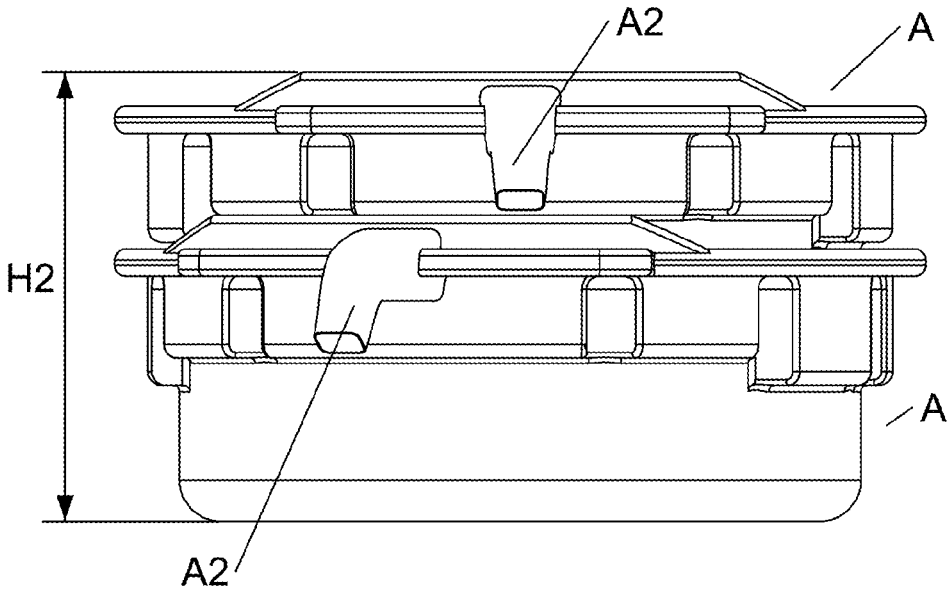
FIG. 8 is a plan view showing the conventional piled oil collection trays.

FIG. 4 and FIG. 8 show a comparison between the oil collection tray 1 of the present invention (as shown in FIG. 1) and the conventional oil collection tray A (as shown in FIG. 5). As shown in FIG. 4, the number of the piled oil collection trays 1 of the present invention is three and the height is H1. As shown in FIG. 8, the number of the conventional oil collection trays A is two and the height is H2. The height H1 is about equal to the height H2. Thus, at the same height, the number of the oil collection trays 1 of the present invention is greater than the number of conventional oil collection trays A. In other words, at the same number, the height of the oil collection trays 1 of the present invention is less than the height of conventional oil collection trays A. The oil collection trays of present invention can be piled up with ease to decrease the volume for transportation and to lower the cost Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An oil collection tray, comprising:

an oil nozzle at an outer side of the oil collection tray, the oil nozzle communicating with the inside of the oil collection tray, the oil collection tray comprising:

a flange and a tray body, the tray body having a plurality of spaced vertical recesses formed on an outer wall thereof and a plurality of protruding ribs formed on an inner wall thereof corresponding in position to the vertical recesses, wherein, when a number of oil collection trays are stacked, the tray body of an upper oil collection tray is placed into the tray body of a lower oil collection tray, the flange of the upper oil collection tray is located on and contacts the top of the flange of the lower oil collection tray, the oil nozzles are positioned to be aligned with one another, the vertical recesses of the tray body of the upper oil collection tray mate with the protruding ribs of the tray body of the lower oil collection tray, and the tray body of the upper oil collection tray extrudes the air inside the tray body of the lower oil collection tray.

2. The oil collection tray as claimed in claim 1, wherein the vertical recesses of the tray body of the oil collection tray extend to a bottom of the oil collection tray to form L-shaped recesses, when the tray body of the upper oil collection tray is placed into the tray body of the lower oil collection tray, the air is expelled from the L-shaped recesses.

3. The oil collection tray as claimed in claim 1, wherein the tray body of the oil collection tray is inclined inward, the inner wall of the tray body is inclined inward, the vertical recesses of the tray body of the oil collection tray have a tapered shape and the protruding ribs have a tapered shape corresponding in shape to the vertical recesses so that the tapered protruding ribs of the tray body of the lower oil collection tray mate with the tapered vertical recesses of the tray body of the upper oil collection tray.

4. The oil collection tray as claimed in claim 1, wherein the nozzle is attached to the flange of the oil collection tray and a bottom edge of the nozzle has an inclined portion and a declined portion leading to an open end of the nozzle, and wherein when a number of oil collection trays are stacked, the nozzle of the upper oil collection tray is located directly above and contacts the nozzle of the lower oil collection tray.

5. The oil collection tray as claimed in claim 1, wherein the oil collection tray is configured so that, when a number of oil collection trays are stacked, the vertical recesses of the tray body of the upper oil collection tray mate with the protruding ribs of the tray body of the lower oil collection tray, and the tray body of the upper oil collection tray expels the air inside the bottom of the tray body of the lower oil collection tray through gaps defined between the protruding ribs of the tray body of the lower oil collection tray and the vertical recesses of the tray body of the upper oil collection tray.

* * * * *